United States Patent [19]

Lagerstrand

[11] Patent Number: 4,998,548

[45] Date of Patent: Mar. 12, 1991

[54] SELF-CLEANING FILTER FOR A DISHWASHER

[75] Inventor: Dan E. Lagerstrand, Jönköping, Sweden

[73] Assignee: Aktiebolaget Electrolux, Stockholm, Sweden

[21] Appl. No.: 461,092

[22] Filed: Jan. 4, 1990

[30] Foreign Application Priority Data

Jan. 11, 1989 [SE] Sweden ..... 8900077

[51] Int. Cl.[5] ..... A47L 15/42

[52] U.S. Cl. ..... 134/111; 210/167; 210/316

[58] Field of Search ..... 134/104.1, 104.4, 111; 68/18 F; 210/167, 171, 251, 314, 316

[56] References Cited

U.S. PATENT DOCUMENTS 2,894,631 7/1959 Levit et al. ..... 134/111 X
3,542,594 11/1970 Smith et al. ..... 134/104.1 X
4,754,772 7/1988 Nord et al. ..... 134/111

FOREIGN PATENT DOCUMENTS 2656557 6/1978 Fed. Rep. of Germany ..... 134/111
308587 2/1969 Sweden ..... 134/111
2204482 11/1988 United Kingdom ..... 134/104.1

*Primary Examiner*—Philip R. Coe
*Attorney, Agent, or Firm*—Pearne, Gordon, McCoy & Granger

[57] ABSTRACT

A device for a dishwasher comprising a collecting container (11) for dishwater, the container being situated at the bottom of the tub, the container communicating with the inlet side of a circulation pump and with the inlet side of a drain pump. The inlet sides of the circulation pump and of the drain pump are at least partly separated from each other by means of a filter (26). By this arrangement, a self-cleaning filter having a protected position is achieved.

8 Claims, 3 Drawing Sheets

SELF-CLEANING FILTER FOR A DISHWASHER

BACKGROUND OF THE INVENTION

The present invention relates in general to dishwashers, and more particularly to pumps, sieves, and filters in dishwashers.

Prior Art

By means of the circulation pump in a dishwasher, water is distributed to nozzles which are provided in the tub and which are placed on one or several rotating arms so that water is sprayed on the dishes. By means of a drain pump, the water is emptied from the dishwasher when the dishwashing cycle has been completed.

Dishwashers of the kind described above are known in the prior art, and are usually equipped with devices preventing large particles, such as food scraps and the like, from entering the circulation path, since such particles can clog the nozzles. In the most simple version, these devices comprises a coarse sieve which is situated above the dishwater collecting container and through which water flows down into the container. The sieve can be removed and cleaned under flowing water. The use of a coarse sieve means that it is possible to remove a major part of the large particles in the tub during the emptying period with the aid of the drain pump, and also with a minimal risk of clogging the sieve, but it also means that comparatively large particles can follow the water into the circulation path and clog the nozzles, requiring that the nozzles be cleaned regularly.

It is also known from the prior art to use fine sieves and filters of different types, such as micro-filters, i.e., very fine filters, in order to remove almost all particles in the circulating water. Because such filters have a large flow resistance and because they also have a great tendency to become clogged, large filter areas and short intervals between cleaning are demanded. Frequent cleaning is both troublesome and time-consuming for the operator. A large, upwardly facing filter area also leaves the filter open to damage by knives, forks, spoons, or the like falling from above.

In order to achieve cleaner circulatiing water with a limited filter area, it has benn suggested to use a fine sieve and replace a part of the fine sieve with a small filter area, the openings of the fine sieve being less than the openings of the nozzles but considerably larger than the openings of the filter. It is thereby expected that the circulating water, at least sometime during the dishwashing cycle, passes throough the filter and is then cleaned of the fine particles. However, these filters are difficult to clean, and they are easily clogged.

SUMMARY OF THE INVENTION

In accordance with the present invention, a device for a dishwasher comprising a collecting container for the dishwater is provided. The container is situated at the bottom of a tub and communicates with the inlet side of a circulation pump and with the inlet side of a drain pump. The container is divided into two parts. One part forms a chamber which at least partly is limited by a fine sieve and which communicates with the inlet side of the circulation pump. The other part is connected to the inlet side of the drain pump. A micro-filter is arranged outside of the fine sieve in such a way that a part of the water circulating to the fine sieve also is allowed to pass through the micro-filter.

The purpose of the present invention is to create a combined sieve/filter system separating the large as well as the fine particles from the circulating path, and conveying all particles, with the exception of bones, large food scraps or the like, to the sewage by means of the drain pump. The filter is so shaped that it is effectively and automatically cleaned and has a protected position.

A preferred embodiment of the present invention is described in the following specification with reference to the accompanying drawings.

DESCRIPTION OF THE PREFERRED EMBODIMENT

Figure 1:
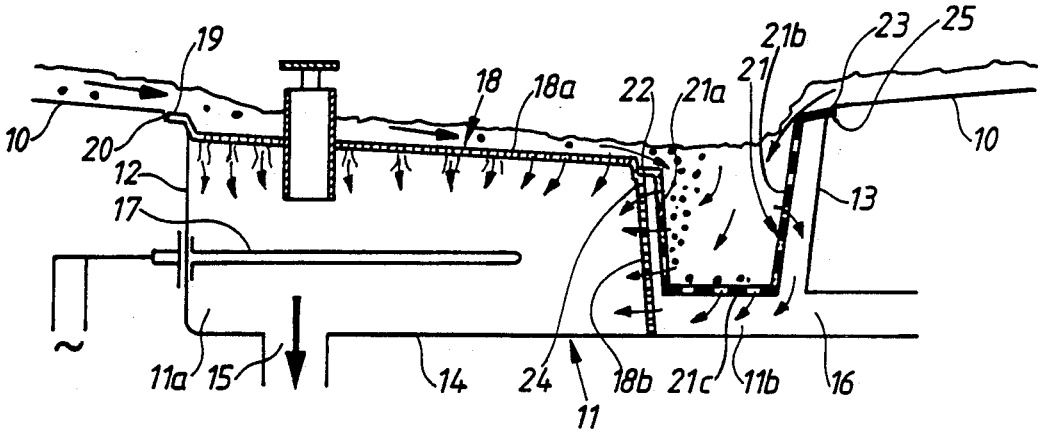
FIG. 1 diagrammatically shows a vertical section through a device according to the present invention during the circulation stage.
Figure 2:
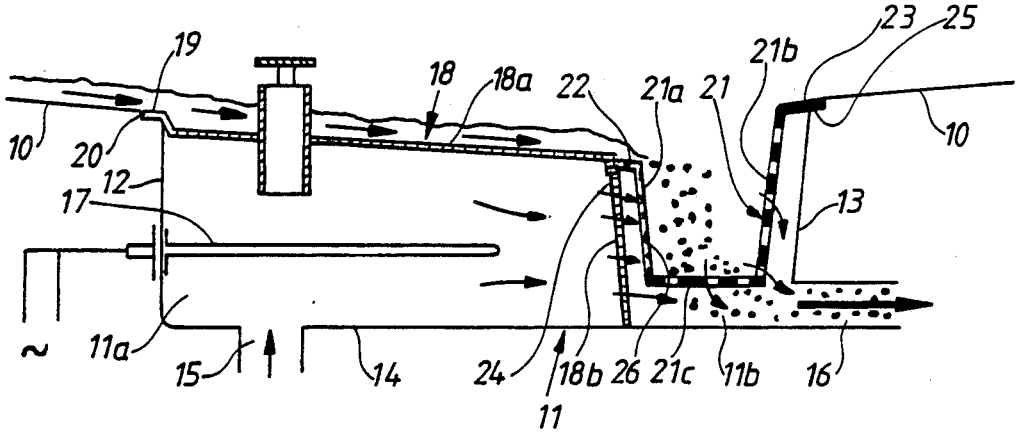
FIG. 2 shows the same section during the emptying stage.

FIGS. 1 and 2 show a part of the bottom plate in a tub having sloping parts 10 on which the circulating dishwater flows during the circulation stage. The lower part of the bottom plate is shaped as an upwardly facing open, boxlike container 11 having mainly vertical wall parts 12 and 13, end walls (not shown), and a bottom 14. The lower part of the container has an opening 15 to which a circulation pump (not shown) is connected and an opening 16 to which a drain pump (not shown) is connected. In said container, there is also an electric heating element 17, by means of which the water in the container can be heated to a suitable temperture. In said container, a fine sieve 18 is placed. This fine sieve is mainly L-shaped, and has an edge part 19 resting in a recess 20, being a border to the sloping parts 10 of the bottom plate of the tub so that a part **18*a* of the fine sieve is a sloping continuation of the sloping parts 10 of the bottom plate. A vertical part 18*b* of the fine sieve rests on the bottom 14, and separates the container into a first chamber 11*a*, which is limited by the fine sieve 18, wall part 12, bottom 14, and the end walls, and into a second chamber 1*b*, which is limited by the vertical part 18*a* of the fine sieve, the wall 13, the bottom 14**, and the end walls.

A coarse sieve 21 is placed in the second chamber **11*b*. The coarse sieve 21 is shaped as an upwardly facing open box with side walls 21*a*, 21*b*, and a bottom 21*c*, and it, as well as the find sieve 18, can be easily removed from the container for cleaning. The side wall 21*b* and the bottom 21*c* of the coarse sieve are placed at such a distance from the wall part 13 and from the bottom 14 of the container that water part 13 and from the bottom 14 of the container that water can flow freely in the spaces formed therebetween. The coarse sieve has two substantially parallel edge parts 22 and 23, respectively, one edge part 22 resting on a shoulder 24 on the fine sieve 18, whereas, the other part 23 rests in a recess 25 on the bottom plate. The side wall 21*a* of the coarse sieve comprises a filter 26, preferably a micro-filter, i.e., a filter having very small flow openings. The filter 26 is placed mainly vertically at a distance from the vertical part 18*b* of the fine sieve. Thus, the filter 26, together with the fine sieve part 18*b*, form a border between the first chamber 11***a* communicating with the circulation pump and the second chamber 11*b* communicating with the drain pump.

The device operates in the following way. During the circulation stage, illustrated in FIG. 1, the circulation pump is activated, causing water to flow from the first chamber 11*a* through the pump to the distribution channels in the dishwasher and to the nozzles from which water is sprayed on the dishes. The water is then returned via the sloping bottom plate to the container 11. A major part of the water flows through the fine sieve 18 back to chamber 11*a*, whereas a minor part passes via the filter 26 in the side wall 21*a* of the coarse sieve back to chamber 11*a*. Because the pressure difference between the two sides of the filter 26 is comparatively small, the particles do not penetrate too deep into the filter 26, but mainly are collected on the surface of the filter 26 facing the coarse sieve, making the filter 26 easy to clean. Since the water circulates through the chamber 11*a* many times during the dishwashing cycle, virtually all the water in the tub has passed through the filter 26 by the time the dishwashing cycle has been completed. When the circulation pump stops and the drain pump starts (see FIG. 2) the water in chamber 11*a* will flow through the filter 26 and through the slot below the coarse sieve. When flowing through the filter 26, the water easily rinses the particles on the filter 26 and the particles follow the water out. In this way, a self-cleaning filter is achieved which, by its substantially vertical position, is protected against damage from items falling from above.

Figure 3:
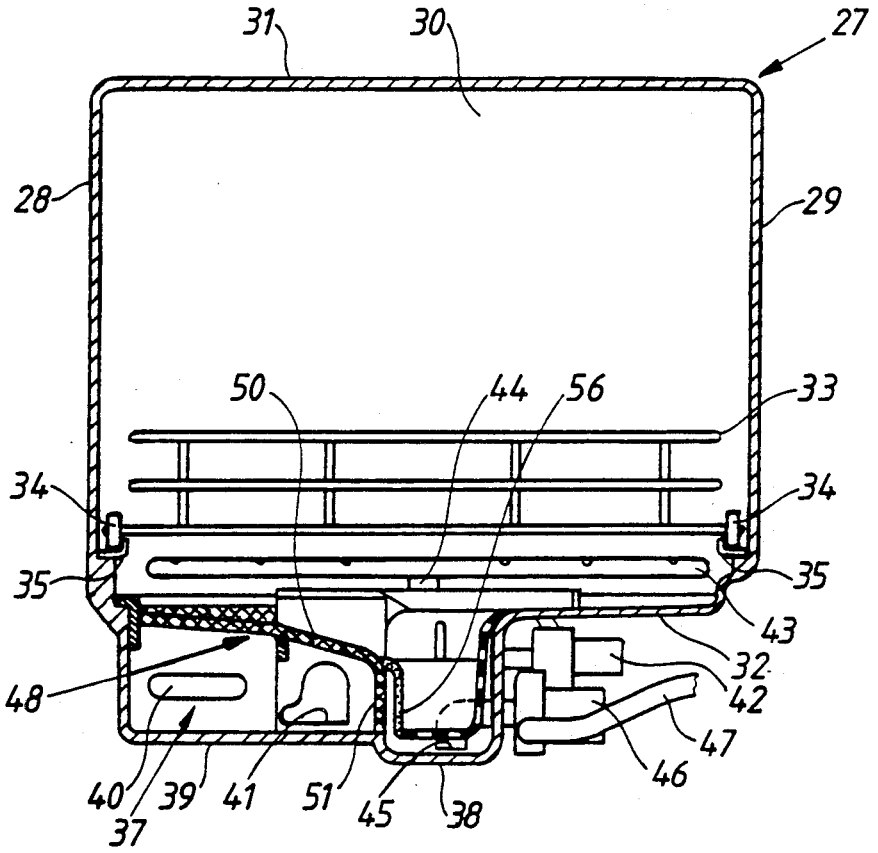
FIG. 3 is a more detailed vertical section through a tub provided with the sieve/filter arrangement according to the present invention.
Figure 4:
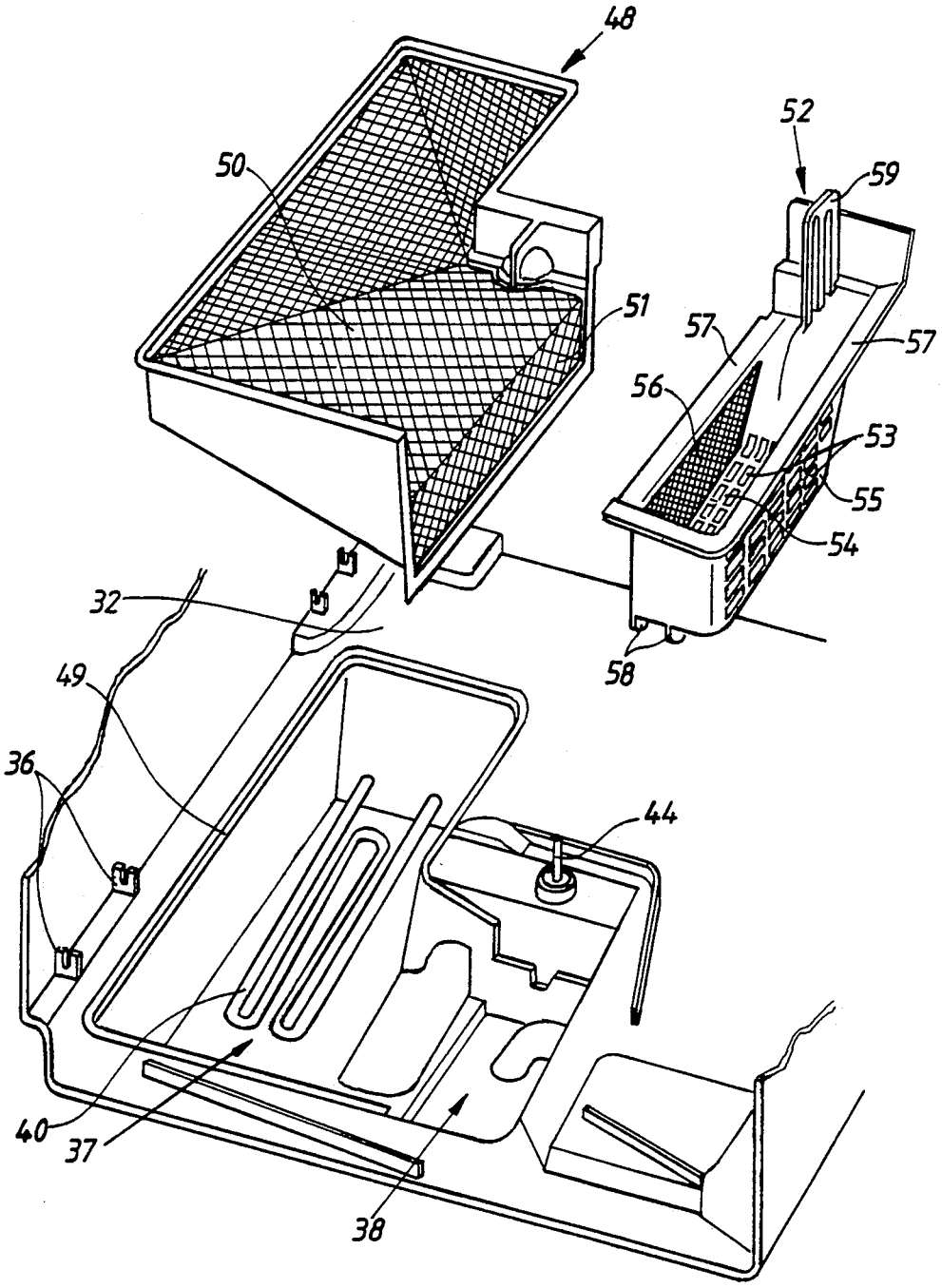
FIG. 4 is an exploded view of the bottom part of FIG. 3, but without certain details.

FIGS. 3 and 4 show a tub 27 consisting of side walls 26, 29, a rear wall 30, a roof part 31, and a bottom plate 32. The front part is normally covered by a lid (not shown) and this lid can be folded down, thereby making a basket 33 for the dishes accessible. The basket is provided with wheels 34 supported on rails 35 which are fastened in the tub by means clamp 36. Below the bottom plate 32, there is a container 37 in which the dishwater is collected for circulation and emptying purposes. The container 37 has at its right-hand side a sump 38 which recessed with respect to the bottom 39 of the container 37. In the container 37 there is an electric heating elememt 40 to heat the water in the container 37, and there is an inlet 41 for a circulation pump 42 distributing the water to a dish arm 43 which is rotating supported on a vertical pipe 44 connected to the outlet of the circulation pump. In the sump 38 near its bottom, there is an inlet 45 for a drain pump 46 which transports the water through a hose 47 to the sewage system to which the dishwasher is connected. The top side of the container 37 is covered by a fine sieve 48 resting in a groove 49 in the bottom plate and having a sloping part 50 ending with a mainly vertical part 51.

Above the sump 38, there is a coarse sieve 52 formed as an upwardly facing open box and having large openings 53 in the bottom 54 and in one side wall 55. The opposite side wall is provided with a micro-filter 56 facing the vertical part 51 of the fine sieve 48. At both side walls, there is a flange 57 sloping towards the interior of the coarse sieve 52 and abutting the fine sieve 48 and the side wall of the container 37, respectively, so that particles flowing down the sloping part 50 of the fine sieve 48 and the bottom plate 32 of the tub are directed into the coarse sieve 52. At the same time, these flanges 57 keep the side walls of the coarse sieve at a certain distance from the vertical part 51 of the fine sieve and from the side wall of the container 37. The coarse sieve 52 is partly supported by shoulders 58 which are provided at the bottom of the coarse sieve so that a slot is created between the sump 38 and the bottom of the coarse sieve 52. The coarse sieve 52 is further provided with a handle 59 by means of which the coarse sieve can be lifted out for cleaning.

Although the preferred embodiment of this invention has been shown and described, it should be understood that various modifications, replacements, and rearrangements of the parts may be resorted to without departing from the scope of the invention as disclosed and claimed herein.

What is claimed:

1. A device for a dishwasher having a circulation pump and a drain pump, said device comprising a collector container (11, 37) for the dishwater, said container being situated at the bottom of a tub (27), said container communicating with the inlet side (15, 41) of the circulation pump and with the inlet side (16, 45) of the drain pump (46), wherein said container is divided into two parts, one part forming a chamber (11*a*) which at least partly is limited by a fine sieve (18, 48) and which communicates with said inlet side (15, 41) of the circulation pump, whereas the other part (11*b*) is connected to said inlet side (16, 45) of the drain pump (46), a micro-filter (21*a*, 56) being arranged outside said chamber in such a way that a part of the water circulating to said fine sieve also is allowed to pass through said micro-filter, said fine sieve comprising a first part (18*a*, 50) sloping downwardly from the bottom of said tub, said first part continuing into a mainly vertical second part (18*b*, 51) resting on the bottom of said container.

2. A device for a dishwasher having a circulation pump and a drain pump, said device comprising a collecting container (11, 37) for the dishwater, said container being situated at the bottom of a tub (27), said container communicating with the inlet side (15, 41) of the circulation pump and with the inlet side (16, 45) of the drain pump (46), wherein said container is divided into two parts, one part forming a chamber (11*a*) which at least partly is limited by a fine sieve (18, 48) and which communicates with said inlet side (15, 41) of the circulation pump, whereas the other part (11*b*) is connected to said inlet side (16, 45) of the drain pump (46), a micro-filter (21*a*, 56) being arranged outside said chamber in such a way that a part of the water circulating to said fine sieve also is allowed to pass through said-filter, said fine sieve (18, 48) and said micro-filter (21*a*, 56) each having a mainly vertical filter area, said fine sieve comprising a first part (18*a*, 50) sloping downwardly from the bottom of said tub, said first part continuing into a mainly vertical second part (18*a*, 51) resting on the bottom of said container.

3. A device according to claim 1, wherein said micro-filter (21*a*, 56) is placed parallel with and at a distance from said second part (18*b*, 51).

4. A device according to claim 2, wherein said mico-filter (21*a*, 56) is placed parallel with and at a distance from said second part (18*b*, 51).

5. A device according to any of the preceding claims, wherein a coarse sieve (21, 52) is placed beside said fine sieve (18, 48), said coarse sieve being shaped as an upwardly facing open box having one side wall comprising said micro-filter (21*a*, 56).

6. A device according to claim 5, wherein the bottom (21*c*, 54) of said coarse sieve (21, 52) is placed somewhat above the bottom (14, 37) of said container.

7. A device for a dishwasher having a circulation pump and a drain pump, said device comprising a collecting container (11, 37) for the dishwater, said container being situated at the bottom of a tub (27), said container communicating with the inlet side (15, 41) of the circulation pump (42) and with the inlet side (16, 45) of the drain pump (46), wherein said container is divided into two parts, one part forming a closed chamber (11*a*) which is partly limited by a fine sieve (18, 48) having at least a mainly vertical area and which communicates with said inlet side (15, 41) of the circulation pump, whereas the other part (11*b*) is connected to said inlet side (16, 45) of the drain pump (46), a micro-filter (21*a*, 56) having a mainly vertical filter area being arranged outside and at a distance from said vertical area of said fine sieve in such a way that a part of the water circulating to said fine sieve also is allowed to pass through said micro-filter, said fine sieve comprising a first part (18*a*, 50) sloping downwardly from the bottom of said tub, said first part continuing into the mainly vertical second part (18*b*, 51) resting on the bottom of said container, the micro-filter being placed at a distance from the bottom of the container.

8. A device according to claim 7, wherein a coarse sieve (21, 52) is integrated with said fine sieve (18, 48), said coarse sieve being shaped as an upwardly facing open box having one side wall comprising said micro-filter (21*a*, 56).

* * * * *